US005868344A

United States Patent [19]

Melnick

[11] Patent Number: 5,868,344

[45] Date of Patent: Feb. 9, 1999

[54] PULL-OUT SLIDABLE TOILET PAPER HOLDER

[76] Inventor: Philip Melnick, 424 Ellis St., San Francisco, Calif. 94102

[21] Appl. No.: 901,114

[22] Filed: Jul. 28, 1997

[51] Int. Cl.[6] ..... B65H 16/02

[52] U.S. Cl. ..... 242/591; 242/597.5; 242/598.2; 242/598.3; 242/599.3

[58] Field of Search ..... 242/591, 592, 242/597.5, 597.7, 598, 598.1, 598.2, 598.3, 598.4, 599, 599.3

[56] References Cited

U.S. PATENT DOCUMENTS

| | | | |
|---|---|---|---|
| Re. 18,448 | 5/1932 | McNally | 242/599.3 |
| 1,665,739 | 4/1928 | Hoegger | 242/598.2 |
| 2,157,419 | 5/1939 | Marchev | 242/598.2 |
| 2,517,809 | 8/1950 | Tarzian | 242/598.2 |
| 3,069,105 | 12/1962 | Press et al. | 242/598 |
| 3,079,099 | 2/1963 | Blain | 242/597.5 |
| 3,138,340 | 6/1964 | Caravella | 242/599 X |
| 3,672,591 | 6/1972 | Davis | 242/597.5 X |
| 4,416,425 | 11/1983 | Kish | 242/598.1 |
| 5,222,678 | 6/1993 | Carrington | 242/598.2 |
| 5,450,981 | 9/1995 | Fields | 242/598.3 X |
| 5,718,396 | 2/1998 | Maresca | 242/598.2 |

FOREIGN PATENT DOCUMENTS

| | | | |
|---|---|---|---|
| 2135466 | 2/1973 | Germany | 242/598.1 |

*Primary Examiner*—Donald P. Walsh
*Assistant Examiner*—William A. Rivera

[57] ABSTRACT

A toilet paper holding device including a base which is adapted to be secured to a wall. The base include a first fixed base arm and a second pivotal base arm. A spindle is threadably secured to an aperture within the pivotal base arm. The pivotal base arm may include a first orientation wherein the spindle is parallel to the base, and a second orientation wherein the spindle is perpendicular to the base.

6 Claims, 3 Drawing Sheets

FIG.3
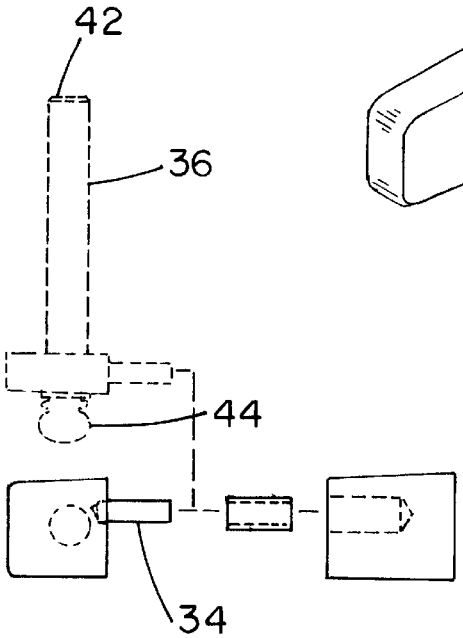
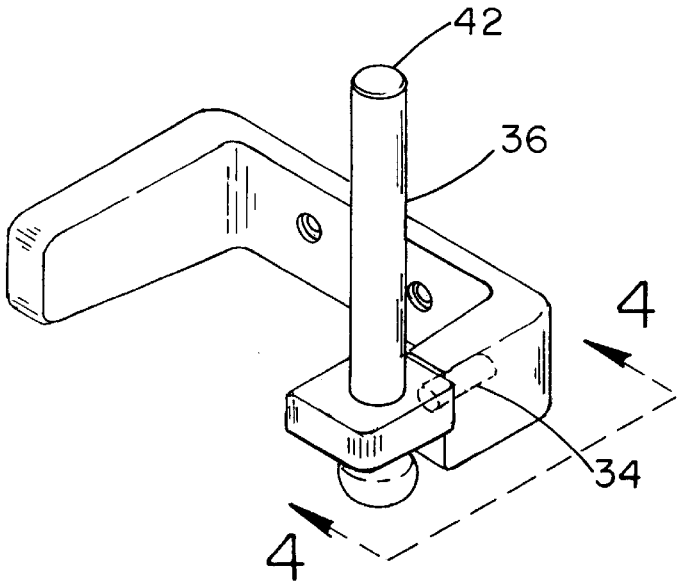
FIG. 4
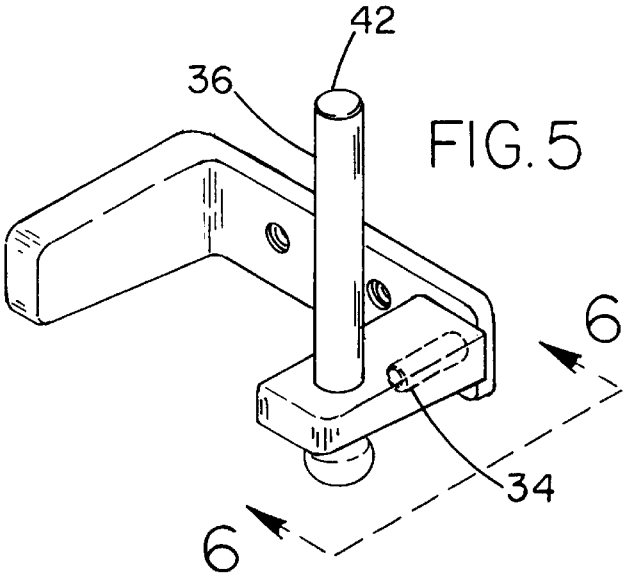
FIG. 5
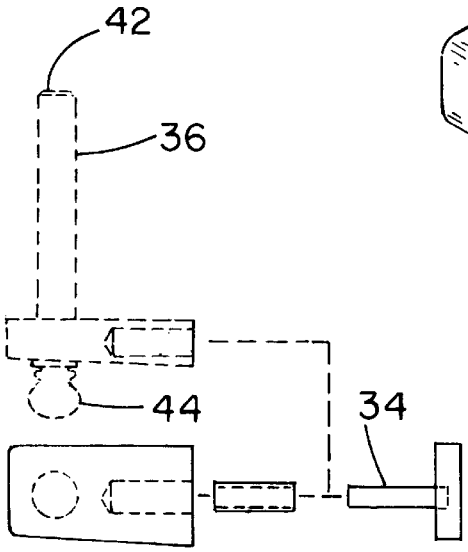
FIG. 6

FIG. 7
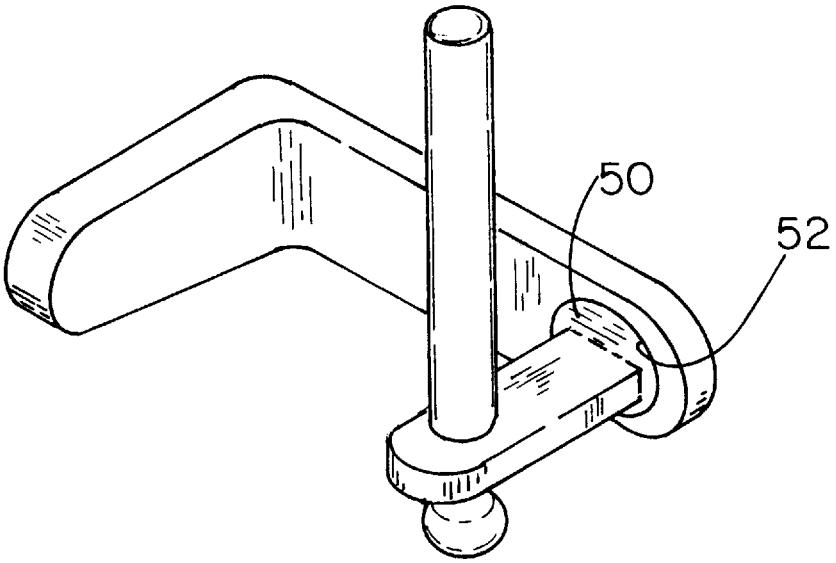
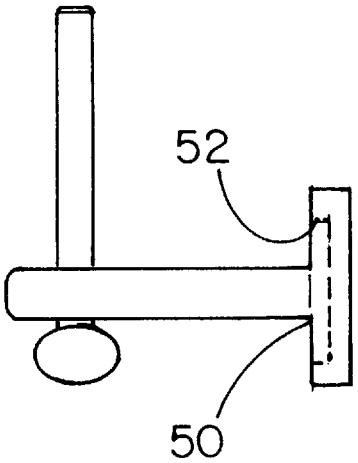
FIG. 8

PULL-OUT SLIDABLE TOILET PAPER HOLDER

BACKGROUND OF THE INVENTION

1. Field of the Invention

The present invention relates to a toilet paper holder and more particularly pertains to a toilet paper holder which is pivotal and slidable.

2. Description of the Prior Art

The use of a toilet paper holders is known in the prior art. More specifically, toilet paper holders are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,416,425 to Kish discloses a paper roll dispenser. U.S. Pat. No. 4,179,077 to Morishita discloses a device for loading a paper roll. U.S. Design Pat. No. 296,963 to Smalwood discloses a mandrel for a paper roll holder. U.S. Pat. No. 4,381,083 to Tsunetsugu discloses a toilet paper holder device. U.S. Pat. No. 4,824,038 to Chandler discloses a holder for rolled paper. Lastly, U.S. Pat. No. 5,222,678 to Carrington discloses a roll holder with a lanyard for retracting support assembly.

In this respect, the toilet paper holder of the present invention substantially departs from the conventional concepts and designs of the prior art, and in so doing provides an apparatus primarily developed for the purpose of facilitating easy replacement of toilet paper rolls.

Therefore, it can be appreciated that there exists a continuing need for toilet paper holders which allow for the easy replacement of toilet paper rolls. In this regard, the present invention substantially fulfills this need.

SUMMARY OF THE INVENTION

In view of the foregoing disadvantages inherent in the known types of toilet paper holders now present in the prior art, the present invention provides a toilet paper holder with two orientations. As such, the general purpose of the present invention, which will be described subsequently in greater detail, is to enable the easy replacement of toilet paper rolls.

To attain this, the present invention essentially comprises a base which is adapted to be secured to a wall. The base has a first end, a second end and an intermediate extent therebetween. The base includes a fixed base arm integral with the second end of the base and a second base arm connected to the first end of the base. A threaded aperture is formed within the second base arm. A spindle having a threaded portion adjacent the first end of the spindle is provided. The threaded portion of the spindle is adjustably secured to the threaded aperture of the second base arm. The spindle can be threadably engaged with the second base arm. It can also be threadably disengaged and then slid out from the second base arm. The various components of the present invention, and the manner in which they interrelate, will be described in greater detail hereinafter.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a pivotal toilet paper roll holding device including a base having a first end, a second end and an intermediate extent therebetween. A pair of mounting apertures are formed within the intermediate extent of the base. A fixed base arm is integral with the second end of the base. This fixed base arm is oriented 90 degrees relative to the base. A pivotal base arm is connected to the first end of the base. A dowel serves to interconnect the first end of the base with the pivotal base arm. The pivotal base arm thus has the capacity to pivot relative to the base by way of the dowel. A threaded aperture is formed within the pivotal base arm. The device also includes a spindle having a first end, a second end and an intermediate extent therebetween. A knob is secured to the first end of the spindle. The spindle has a threaded portion adjacent the first end of the spindle. This threaded portion of the spindle is adjustably secured to the threaded aperture of the pivotal base arm. The spindle thus has a first orientation, wherein the spindle is threadably engaged with the aperture such that the second end of the spindle does not contact with fixed base arm. In the first orientation the pivotal base arm is free to pivot relative to the base. The spindle also has a second orientation wherein the spindle is threadably engaged with the aperture such that the second end of the spindle is in contact with the fixed base arm. In the second orientation rotation of the pivotal base arm relative to the base is not permitted.

It is another object of the present invention to provide a toilet paper holder with two orientations: a use orientation and a replacement orientation.

It is a further object of the present invention to provide a toilet paper holder with prevents the theft of roller shafts.

An even further object of the present invention is to provide a toilet paper holder of a one piece construction which is susceptible of a low cost of manufacture with regard to both materials and labor, and which accordingly is then susceptible of low prices of sale to the consuming public, thereby making such toilet paper holders economically available to the buying public.

Still yet another object of the present invention is to provide toilet paper holders with a first secured orientation and a second orientation which provides in the apparatuses and methods of the prior art some of the advantages thereof, while simultaneously overcoming some of the disadvantages normally associated therewith.

Still another object of the present invention is to enable the changing of a toilet paper roll with one hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view of the second embodiment of the toilet paper holding device of the present invention.

FIG. 4 a view taken along line 4—4 of FIG. 3.

FIG. 5 is a perspective view of the primary embodiment of the present invention.

FIG. 6 is view taken along line 6—6 of FIG. 5.

FIG. 7 is a perspective view of the final embodiment of the present invention.

FIG. 8 is a side elevational view partly in cross-section of the embodiment of FIG. 7.

Similar reference characters refer to similar parts throughout the several views of the drawings.

DESCRIPTION OF THE PREFERRED EMBODIMENT

Figure 1:
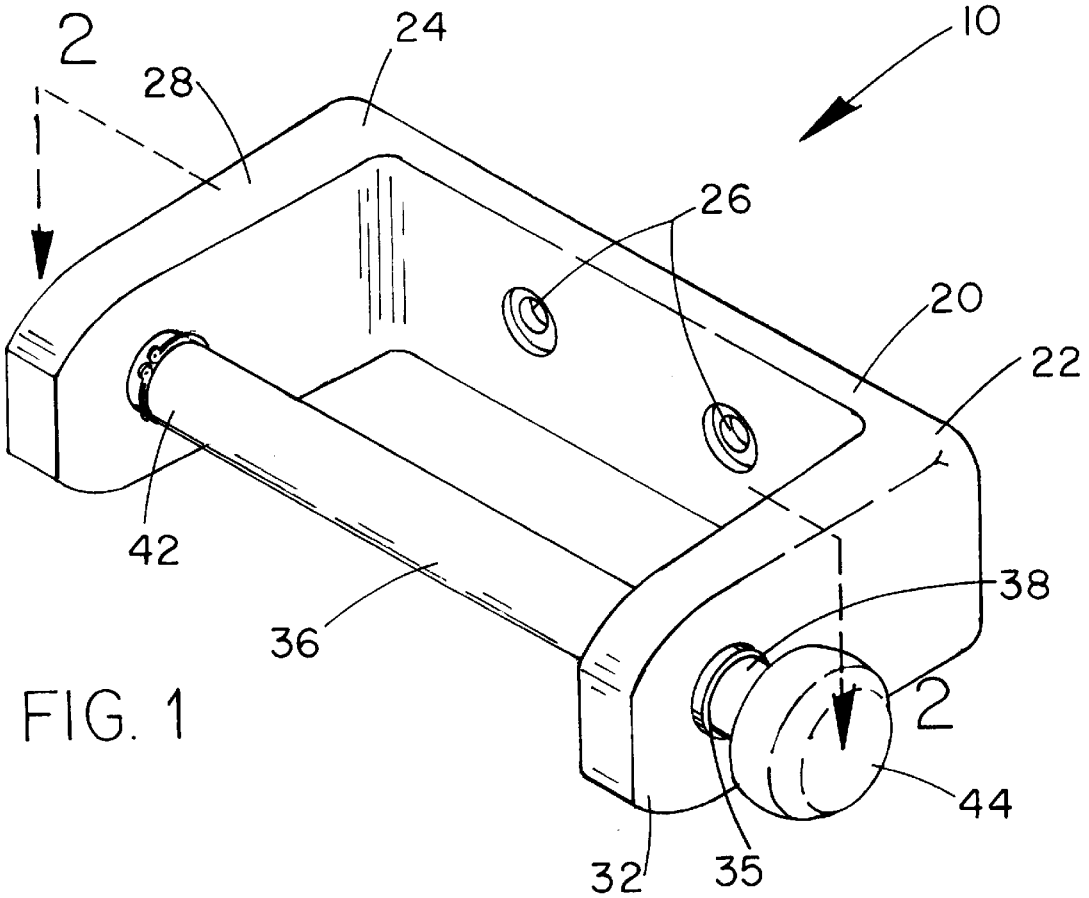
FIG. 1 is perspective illustration of the toilet paper holder of the present invention.
Figure 2:
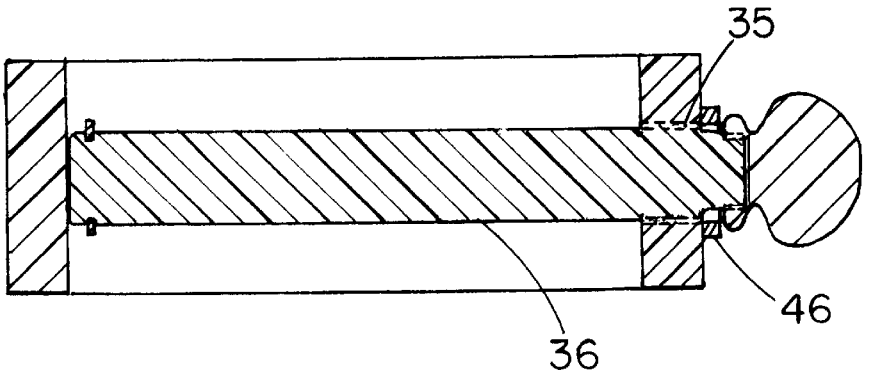
FIG. 2 is sectional view taken along line 2—2 of FIG. 1.

With reference now to the drawings, and in particular to FIG. 1 thereof, the present invention relate to a pivotal and or pull-out slidable toilet paper holder 10. In its broadest context, the present invention includes a base which is adapted to be secured to a wall. The base include a first fixed base arm and a second pivotal base arm. A spindle is threadably secured to an aperture within the pivotal base arm. The pivotal base arm has a first orientation wherein the spindle is parallel to the base, and a second orientation wherein the spindle is perpendicular to the base. The various components of the present invention, and the manner in which they interrelate, will be described in greater detail hereinafter.

The pivotal toilet paper roll holding device 10 includes a base 20 having a first end 22, a second end 24 and an intermediate extent therebetween. A pair of mounting apertures 26 are formed within the intermediate extent of the base 20. These mounting apertures 26 enable the pivotal toilet paper holder 10 to be fixed to a wall or other surface. The roll holding device also includes a fixed base arm 28 which is integral with the second end 24 of the base 20. As depicted in FIG. 3, the fixed base arm 28 is oriented 90 degrees relative to the base.

Furthermore, a pivotal base arm 32 is connected to the first end 22 of the base 20. In the preferred embodiment, a dowel 34 serves to interconnect the first end of the base 22 with the pivotal base arm 32. This dowel 34 is depicted in phantom in FIGS. 3 and 5. The dowel 34 is positioned within the first end 22 of the base 20 and also within the pivotal base arm 32. In this manner, the pivotal base arm 32 has the capacity to pivot relative to the base 20 by way of the dowel 34. Additionally, a threaded aperture 35 is formed within the pivotal base arm 32. The function of this threaded aperture 35 will be described in greater detail hereinafter.

The spindle 36 is defined by a first end 38, a second end 42 and an intermediate extent therebetween. In the preferred embodiment, a knob 44 secured to the first end 38 of the spindle 36. Additionally, the spindle 36 has a threaded portion 46 adjacent to the first end 38 of the spindle 36. This threaded portion 46 of the spindle is adjustably secured to the threaded aperture 35 of the pivotal base arm 32. Thus, the spindle 36 is threadably interconnected to the pivotal base arm 32. Such a pivotal interconnection allows the position of the spindle 36 relative to the pivotal base arm 32 to be adjusted. Through such adjustment two orientations are affected. Namely, the spindle has a first orientation, wherein the spindle is threadably engaged with the aperture such that the second end of the spindle does not contact with fixed base arm. In this first orientation, the pivotal base arm is free to pivot relative to the base. In the second orientation, the spindle is threadably engaged with the aperture such that the second end of the spindle is in contact with the fixed base arm. Thus, in the second orientation rotation of the pivotal base arm relative to the base is not permitted.

In use, the knob to the spindle is rotated until the first orientation is achieved. The pivotal spindle arm is then rotated until the pivotal base arm is perpendicular to the base. In this configuration a roll of toilet paper can be positioned upon the spindle. The spindle is then rotated until the spindle is parallel with the base. The knob of the spindle is then rotated. Such rotation places the second end of the spindle into firm contact with the fixed base arm. This is the second orientation.

FIGS. 3 and 4 illustrate a second embodiment of the present invention, wherein, only a limited portion of the base arm is pivotal. Additionally, the present invention can be employed in conjunction with a toilet paper holder wherein the second arm 32 is not pivotal. FIG. 1 represents such an embodiment. In this embodiment, a paper roll is replaced by first rotating the spindle. Once rotated to disengage the threads the spindle can be slid out from both of the arms. A new roll can then be placed between the arms. Upon replacing the spindle rotation of the spindle engages the threads of the second arm with the threads of the spindle. In this configuration, the spindle cannot be slid relative to the arms.

The final embodiment of the invention is shown in FIGS. 7 and 8. In such embodiment, the second base arm is formed as in the prior embodiments except that the interior end thereof has formed therewith a cylindrical-shaped component 50. Such cylindrical-shaped component has a circular cross section. The cylindrical-shaped component 50 is received into a similarly-configured hole 52 formed in the base 20. This relationship between the component and hole allow for rotation of the base arm for loading and unloading toilet paper as required.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A toilet paper roll holding device comprising, in combination:

a base having a first end, a second end and an intermediate extent therebetween, a pair of mounting apertures formed within the intermediate extent of the base, a fixed base arm integral with the second end of the base, the fixed base arm oriented 90 degrees relative to the base;

a pivotal base arm connected to the first end of the base, a dowel serving to interconnect the first end of the base with the pivotal base arm, the pivotal base arm having the capacity to pivot relative to the base by way of the dowel, a threaded aperture formed within the pivotal base arm;

a spindle having a first end, a second end and an intermediate extent therebetween, a knob secured to the first end of the spindle, the spindle having a threaded portion adjacent the first end of the spindle, the threaded portion of the spindle being adjustably secured to the threaded aperture of the pivotal base arm, the spindle thus having a first orientation, wherein the spindle is threadably engaged with the aperture such that the second end of the spindle does not contact with fixed base arm, in the first orientation the pivotal base arm is free to pivot relative to the base, the spindle having a second orientation wherein the spindle is threadably engaged with the aperture such that the second end of the spindle is in contact with the fixed base arm, in the second orientation rotation of the pivotal base arm relative to the base is not permitted;

a cylindrical component at the interior end of the second base arm in a cylindrical hole of the base for rotation thereof.

2. A toilet paper roll holding device comprising:

a base having a first end, a second end and an intermediate extent therebetween, a fixed base arm integral with the second end of the base;

a second base arm connected to the first end of the base, a threaded aperture formed within the second base arm;

a spindle having a first end, a second end and an intermediate extent therebetween, the spindle having a threaded portion adjacent the first end of the spindle, the threaded portion of the spindle being adjustably secured to the threaded aperture of the second base arm;

a cylindrical component at the interior end of the second base arm in a cylindrical hole of the base for rotation thereof.

3. The toilet paper roll as described in claim 2 further comprising:

a pair of mounting apertures formed within the intermediate extent of the base.

4. The toilet paper roll as described in claim 2 further comprising:

a knob secured to the first end of the spindle.

5. The toilet paper roll as described in claim 2 wherein the second base arm is rotatable at an intermediate extent thereof.

6. The toilet paper roll as described in claim 2 wherein the second base arm is rotatable at its interior end thereof.

* * * * *